US005590485A

United States Patent [19]

Brandl

[11] Patent Number: 5,590,485

[45] Date of Patent: Jan. 7, 1997

[54] RIB FOR FIREARM AND METHOD OF MAKING A BARREL WITH RIB

[75] Inventor: Rudolf Brandl, Dornhan-Weiden, Germany

[73] Assignee: Heckler & Koch GmbH, Oberndorf/Neckar, Germany

[21] Appl. No.: 423,290

[22] Filed: Apr. 17, 1995

[30] Foreign Application Priority Data

Feb. 17, 1995 [DE] Germany ..... 195 05 434.2

[51] Int. Cl.[6] ..... F41A 21/24

[52] U.S. Cl. ..... 42/102; 42/76.02; 89/16

[58] Field of Search ..... 42/76.01, 76.02, 42/78, 102; 89/14.05, 16

[56] References Cited

U.S. PATENT DOCUMENTS

| | | | |
|---|---|---|---|
| 301,233 | 7/1884 | Hauck | 89/14.05 |
| 1,468,902 | 9/1923 | Fabry et al. | 42/76.01 |
| 2,404,904 | 7/1946 | Collins | 42/76.02 |
| 3,005,263 | 10/1961 | Lockwood . | |
| 3,025,765 | 3/1962 | Baker | 89/16 |
| 3,107,450 | 10/1963 | Snyder et al. . | |
| 3,260,008 | 7/1966 | Yeomans, Jr. . | |
| 4,729,806 | 3/1988 | Stein | 42/76.02 |

FOREIGN PATENT DOCUMENTS

| | | | |
|---|---|---|---|
| 0256173 | 2/1988 | European Pat. Off. . | |
| 1037369 | 9/1953 | France | 42/76.01 |

*Primary Examiner*—Stephen M. Johnson

*Attorney, Agent, or Firm*—Cohen, Pontani, Lieberman, Pavane; Christa Hildebrand

[57] ABSTRACT

The invention provides a rib for a firearm, especially a shotgun, made of a material with poor heat conductivity, for example glass-fiber-reinforced plastic, and, in a method for manufacturing a barrel provided with such a rib, is either manufactured separately from barrel or molded onto the barrel directly.

4 Claims, 1 Drawing Sheet

RIB FOR FIREARM AND METHOD OF MAKING A BARREL WITH RIB

BACKGROUND OF THE INVENTION

1. Field of the Invention

The invention relates to a rib for a firearm, especially a shotgun, and a method for making a barrel provided with a rib.

To focus on a target with a firearm, for example a shotgun (smoothbore rifles), a rib is mounted on the top of the barrel and used for sighting when shooting. This rib extends over at least a portion of the barrel and is permanently or adjustably connected to the barrel.

2. Description of the Related Art

Known shotgun ribs are milled from metal and soldered or brazed to the barrel. During manufacture, the barrel and the rib are white-finished, then soldered together and finally black-finished or black-finished. Milling the ribs is highly labor-intensive and the soldering to the barrel is difficult.

To simplify the manufacture of a revolver barrel with a rib, the rib can be made from die-cast zinc and fastened to the muzzle of the barrel or the frame of the revolver. However this is not possible in a shotgun, because a rib of this kind fastened only at its ends is not sufficiently rigid. Additionally bolting the rib between its ends to the barrel is not possible because of the generally thin wall of the barrel.

In most instances, ribs are mounted on single-barrel shotguns (top-break shotguns, repeating shotguns, automatic shotguns, or double-barreled shotguns). It is also possible however to use ribs in conjunction with weapons in which two, and theoretically even more, barrels are located one above the other or side by side, such as double-barreled shotguns, over-and-under shotguns, and double-barreled rifles. On single-barreled rifles as well (such as top-break or repeating rifles, a rib is often provided. The rib can have a flat surface or a surface that is bent downward (so-called hollow ribs). The cross section of a rib can be limited on the top by a straight line (with respect to the line of sight) or can be curved so that the rib forms a shallow groove to some degree.

When several shots are to be fired sequentially from a shotgun barrel, as is often the case when hunting or skeet shooting, the barrel heats up considerably. Consequently the air in the vicinity of the barrel is heated as well. As a result the shooter does not see a clear image as he looks along the line of sight, but a more or less seriously distorted image, called schlieren or schliering (optical inhomogeneities in the air caused by heat). This defect is reinforced by conventional welded ribs since these form a sort of cooling rib on the barrel, where an especially intensive heat exchange with the ambient air takes place. In order to reduce the schliering in the vicinity of the line of sight, particularly in sporting shotguns, so-called ventilated ribs are used that have openings in the side abutting the barrel. These openings can be traversed by cooling air and thus constitute ventilated spaces between parts of the rib and the top of the barrel facing it. These spaces are separated from one another by sections of the rib in the shape of bridge piers that extend to the barrel and are welded to it. No ventilation takes place in the vicinity of these openings, so that schlieren waves still occur at least these areas.

Ventilated ribs also have the advantage that they are lighter than solid ribs. Consequently, not only is the total weight of the shotgun reduced, but tracking a moving target with the shotgun is facilitated as well. One disadvantage of the ventilated rib is its increased manufacturing cost, since the openings must be milled cleanly. The object of the present invention is to provide an improved rib and consequently an improved barrel. The rib is intended to be simple to manufacture and mountable on the barrel.

SUMMARY OF THE INVENTION

The object of the present invention is to provide a rib for a firearm, especially a shotgun, made of a material having poor thermal conductivity, i.e. clearly lower than that of the barrel which, most likely is made of steel.

The rib according to the invention, made of material of poor heat conductivity, and thus, the surface of the rib facing the line of sight is much colder than the rest of the surface of the barrel when the latter is hot from firing. Schlieren (optical inhomogeneities in the air caused by heat) will not occur above the rib, and thus, precision in focusing along the line of sight is improved.

In addition, the rib prevents the occurrence of schlieren caused by the adjacent surface of the barrel from adversely affecting the line of sight, because the heated air can rise only to either side of the rib and thus does not affect the line of sight.

In addition, a rib made from a material with poor thermal conductivity is easily produced, because no special shape is required for avoiding the formation of schlieren.

Any material with low thermal conductivity can be used as material for making the rib, e.g., horn or rare wood.. This material is already used for parts in rifle making. A ceramic material is also possible.

Preferably, a rib is made completely or partially of plastic, especially preferably is duroplastic plastic. This material prevents the rib from undergoing a loosing in strength when the barrel becomes unusually hot from firing.

In another preferred embodiment, one or more reinforcing means are embedded in the rib. Thus, for improved dimensional stability and rigidity, the basic material forming the rib is made for example of a relatively flexible plastic. Such a basic material, at least in the area abutting the barrel, has the advantage that the barrel can expand freely when heated. In addition the shape of the rib can be adapted to that of the surface of the barrel.

As a reinforcing means, a sheet metal can be used. It forms a portion of the rib facing away from the barrel and adjacent to the line of sight, and is roughened, given a matte finish.

Also contemplated is fibrous material as a reinforcing means. Fibers have the advantage that the direction of the fiber can be adjusted to run the direction of the rib which also simplifies the production of the rib.

Fibers made of different materials for embedding in plastic are known. However, according to the invention, glass fibers are preferred because they are inexpensive and can be manufactured easily because of their relatively high lateral load capacity.

Because ribs of this kind is much lighter than a metal rib and because it is dimensionally stable due to the fiber component, it is also possible to fasten these ribs by their rear ends to the action and in certain cases rivet them to the wall of the barrel at their forward ends.

In another preferred embodiment, the rib is fastened to the barrel by adhesive. High-strength, heat-resistant adhesive connections, for example using epoxy resins, are known in technology, for fastening the outer skins of high-speed aircraft. Such use of adhesives is not only simple and exhibits a strength that completely matches that of a soft-soldered joint, but when an adhesive with limited flexibility is chosen, also has the advantage that it distributes local stresses and thus reduces them. Therefore a relatively small surface is sufficient, at which the rib is glued to the barrel, to ensure a permanent and reliable hold for the rib.

On the basis of the low thermal conductivity of the ribs according to the invention, they can be made solid. It is also important in this regard that a possibly fiber-reinforced plastic can have a very much lower weight than the steel that has been used heretofore for ribs. Such a rib does not adversely affect rapid target acquisition by means of a gun even when it is made unusually high and wide.

In another preferred embodiment, the rib has openings on its side that faces the barrel. Therefore it is made similar to the known ventilated ribs. These openings however, unlike those in known ribs, do not serve for ventilation and hence reduction of schlieren, but primarily to reduce the weight and to retain the appearance to which the shooter is accustomed in a quality weapon.

However, there is yet another advantage: at those points at which the rib according to the invention abuts the outer surface of the barrel, less heat can be given off than at other areas of the barrel. The openings not only serve to allow heat to be given off unimpeded in their vicinity, but also serve to allow heat to be carried away in the axial direction of the barrel from the remaining areas at which the rib abuts the barrel. This prevents heat buildup, which, when the barrel is heated unusually by firing, could otherwise lead to weakening or even damage to the bond between the barrel and the rib.

At the same time the arrangement of these openings allows the use of a wider rib, which in an ordinance weapon for example, can possibly also be designed as a mounting base for additional devices, for example for a special aiming device (spot sight, or laser sight).

In another preferred embodiment, the side of the rib that faces away from the barrel is made as a flat surface. As has already been mentioned several times above, this is advantageous. In particular, the rib extends over the entire length of the barrel.

In another preferred embodiment, the side facing away from the barrel is bent slightly toward the barrel in its central area. Thus a hollow rib is produced, which is often preferred by hunters to the straight rib. One advantage of this hollow rib from the manufacturing standpoint is that the rib has the same height over the length of the barrel, so that an extruded material with limited flexibility can be pressed against the barrel in a clamp to make the rib, and then glued to it. The ends of the rib in this case are preferably adjusted to the length of the barrel only after gluing. As already stated at the outset, the rib according to the invention is preferably used on single-barreled weapons, including repeating shotguns (pump guns) and automatic shotguns. However it is also possible to use the ribs according to the invention in conjunction with weapons in which two shotgun barrels are located side by side. The rib can be extended downward so that it forms receptacles for gluing the two shotgun barrels on both sides. Especially advantageously, the rib according to the invention is mounted on two barrels one above the other. The lower barrel can be a rifle barrel but preferably is also a smooth barrel like the upper barrel. In such a double-barreled shotgun, which is used particularly as a sporting shotgun, relatively tall ribs are often used to provide a flat surface that slopes slightly with respect to the line of sight from the rear edge of the action to the muzzle. In this connection the invention allows the use of a tall yet lightweight rib and hence the use of higher and hence more stable systems than can be used at present for sporting shotguns.

Known ribs are regularly surface-treated in the same way as the barrel adjoining them and hence are usually black (blued) or gray (bonderized).

Using plastic for the ribs permits other colorations to be used in an especially problem-free manner, which can be accomplished simply and permanently by using a colored plastic, or forming colored zones, such as a colored central stripe, possibly by applying a colored plastic adhesive, preferably by means of a strip decal.

According to yet another preferred embodiment, it is especially advantageous to use a highly visible or luminous color to color the rib according to the invention; this facilitates precise acquisition of a target even in late twilight.

In the method according to the invention for manufacturing a barrel, initially a rib made of a material with low thermal conductivity and the barrel are made separately and then connected together.

While heretofore the rib and the barrel were usually welded together in the white and then finished jointly, it is especially advantageous according to the invention to completely finish the barrel and blue it, and to completely finish the rib, and only to join the barrel and the rib by gluing them. In this way it is possible to wipe or wash off any adhesive that escapes as long as it is still spreadable, from the blued or bondered surface of the barrel, without scratching or otherwise damaging it.

In another preferred method, to make the rib, a blank of fiberglass-reinforced plastic is placed in a heatable mold, heated in it, squeezed, and possibly cured.

If the rib according to the invention is made with fibers, it is especially advantageous for its manufacture to preshape it with glass fibers saturated with plastic, so-called prepregs, and then heated. In this manner, even a complexly shaped rib can be manufactured especially economically and simply. The surface facing the line of sight can be provided with molded roughened areas and the desired surface coloration of the rib can be achieved by appropriate coloration of the plastic wetting the fibers.

After removal from the mold, the rib manufactured by the method according to the invention must be deburred. Subsequent general finishing is not required.

Moreover it is possible to place the front sight, which as a rule is made in the form of a small metal or plastic ball whose color contrasts with that of the rib, and cast it at the same time. It is also possible and sometimes advantageous to provide a conventional threaded bore for such a front sight subsequently in the rib. Thus the shooter is enabled to provide his weapon with a front sight of his own choosing.

In rifles for ordinance purposes however it is also possible to mount a large front sight on the muzzle end of the rib. It can be cast in one piece with the rib and therefore molded together with the latter. The rib according to the invention can be made as a separate part and advantageously mounted on the barrel (by means of an adhesive or by ultrasonic gluing; the first method requires only a simple device for clamping the rib to the barrel while the adhesive cures, while the second method has the advantage that it can be performed especially quickly and neatly, since no escaping adhesive need be removed.

However under certain circumstances it is also possible and often advantageous to cast the rib according to the invention directly on the barrel.

For this purpose, a hollow mold is used that has a recess to receive the finished barrel and a recess adjoining it that is intended to form the rib.

This hollow mold is either designed as an injection mold, with molten plastic being injected into the recess to form the rib after the barrel is inserted or as a heatable compression mold in which a prepreg is placed in the recess that forms the rib after the barrel has been inserted. The prepreg is impregnated with an adhesive plastic or has an adhesive additive. Then the prepreg and the barrel are pressed together and heated.

The invention will now be described with reference to embodiments and the attached drawing in greater detail.

DETAILED DESCRIPTION OF THE PREFERRED EMBODIMENTS

Figure 1:
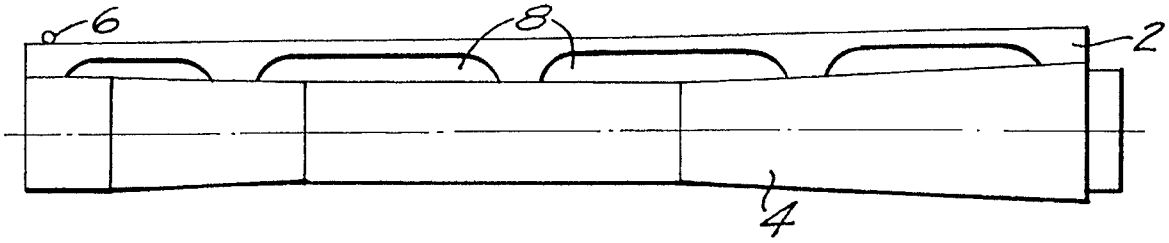
FIG. 1 is a schematic side view of a ventilated rib on a shotgun barrel.

In all three figures, a shotgun barrel 4 is shown with muzzle located at the left in the drawing and whose breech is at the right side in the drawing. The length of shotgun barrel 4 is considerably reduced.

FIG. 1 shows a shotgun barrel 4 with a ventilated rib 2 fastened to its top. This ventilated rib 2 has a flat surface on its side facing away from barrel 4. On its side facing barrel 4 rib 2 has elongated openings 8 extending lengthwise so that rib 2 contacts barrel 4 only by columnar sections between each two adjacent openings 8. Rib 2 is glued to barrel 4 at these sections.

A front sight 6 is mounted in conventional fashion at the muzzle end of rib 2 on the top of the barrel.

Barrel 4 does not have a cylindrical or continuously tapered external shape, but has an outside diameter that tapers from the breech forward roughly corresponding to the internal pressure in the barrel when firing. The outside diameter of barrel 4 however increases again toward the muzzle, since it has a receptacle for interchangeable choke inserts at its muzzle. If such a receptacle is not provided, barrel 4 tapers to the muzzle. Rib 2 in any case has the side that faces barrel 4 adapted to the latter.

Figure 2:
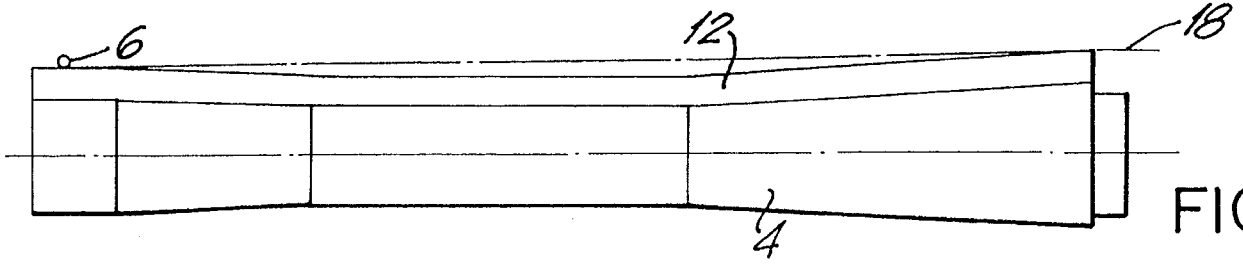
FIG. 2 is a view similar to FIG. 1, with a depressed solid rib.

FIG. 2 shows a barrel 4 which is likewise designed like barrel 4 in FIG. 1. Rib 12 differs from the rib in FIG. 1 in that it is solid. In addition, the surface facing away from the barrel is not flat, as in rib 2 in FIG. 1, but is bent slightly toward the barrel in the central area of barrel 4 to form a hollow rib. At the muzzle, rib 12 has a front sight 6, corresponding to front sight 6 in the embodiment in FIG. 1. Line of sight 18, that extends from the rear upper edge of rib 12 over rear sight 16 thus does not coincide with the surface of the rib.

Figure 3:
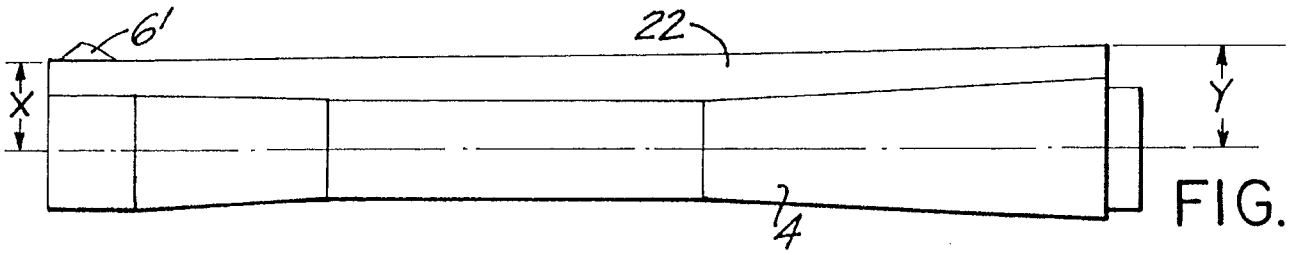
FIG. 3 is a view similar to FIGS. 1 and 2, with a solid rib that runs in a straight line.

FIG. 3 shows a barrel 4 which coincides as such with barrels 4 shown previously. Rib 22 corresponds in shape essentially to rib 2 in FIG. 1, but does not have openings 8; it is made either solid or hollow if it is desirable to make it lighter. In addition, a front sight 6' is molded onto rib 22.

As shown in FIG. 3, the height y relative to the axis of the bore (central axis of barrel 4) is much greater than the height x of rib 22 at the muzzle. This design has its basis in the fact that in large-caliber shotguns, heavy slugs, teargas canisters, or shot are occasionally fired at relatively low speed, so that not only is the effective range less but a very sharply curved trajectory is involved. The line of sight therefore must be tilted downward relative to the axis of the bore.

Figure 4:
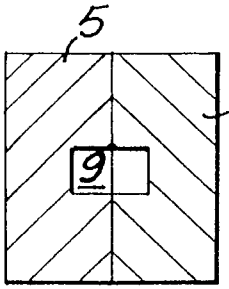
FIG. 4 is a schematic cross section through a hollow mold for making a separate rib.

FIG. 4 shows a schematic cross section through a hollow mold for making a separate rib. The hollow mold is composed of two mold halves 5 and 7 enclosing a mold cavity 9. The two mold halves 5, 7 are either locked together in the closed state and a molten plastic is injected into mold cavity 9, or, with the mold open, a prepreg (a glass fiber extruded impregnated with plastic) is placed in open mold cavity 9. Then mold halves 5, 7 are heated and pressed together, forming a separate rib 4 as a casting or a molding.

Figure 5:
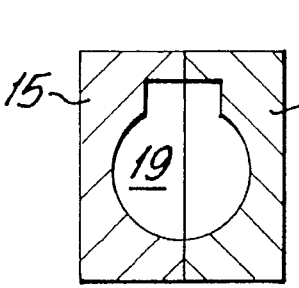
FIG. 5 is a schematic cross section through a hollow mold for molding the rib onto a barrel.

In FIG. 5, a schematic cross section is shown through a hollow mold for making a rib that is connected from the outset with barrel 4; the hollow mold is formed of two mold halves 15 and 17 enclosing a mold cavity 19.

The two mold halves 15, 17 may be closed after placing the barrel in the open mold and then locked together, after which a molten plastic is injected into the part of the mold cavity 19 that is not occupied by the barrel and abuts its outer circumference. Alternatively, with the mold open, barrel 4 and a prepreg are inserted in open mold cavity 19. Then mold halves 15, 17 are heated and pressed together. This produces a barrel 4 with a molded rib 4 as a composite casting or a composite molding.

What is claimed is:

1. A method for manufacturing a rib for a barrel of a firearm, comprising the steps of providing a heatable two-part rib mold;

placing a blank of glass-fiber-reinforced plastic into the mold;

heating the mold;

pressing the two-part mold together;

separating the formed rib from the mold; and adhering the formed rib to the barrel with glue.

2. A method for manufacturing a rib for a barrel of a firearm, comprising the steps of providing a heatable two-part rib mold;

placing a blank of glass-fiber-reinforced plastic into the mold;

heating the mold;

pressing the two-part mold together;

separating the formed rib from the mold and adhering the formed rib to the barrel by ultrasonic welding.

3. A method for manufacturing a barrel having an integral rib comprising the steps of providing a two-part mold having a cavity for accepting the barrel and a cavity for forming the rib;

placing the barrel into the mold;

injecting plastic into the cavity for forming the rib; and pressing the two-part mold together.

4. A method for manufacturing a barrel having an integral rib comprising the steps of providing a two-part mold having a cavity for accepting the barrel and a cavity for forming the rib;

placing the barrel into the mold;

placing a prepreg blanc including adhesive into the cavity for forming the rib; pressing the two-part mold together; and curing the prepreg while in the mold.

* * * * *